US005816397A

United States Patent [19]

Pratt

[11] Patent Number: 5,816,397

[45] Date of Patent: Oct. 6, 1998

[54] GOLF CLUB CARRYING APPARATUS

[75] Inventor: Michael J. Pratt, Park City, Utah

[73] Assignee: Ogio International, Inc., Salt Lake City, Utah

[21] Appl. No.: 785,983

[22] Filed: Jan. 21, 1997

[51] Int. Cl.[6] ..... A63B 55/00

[52] U.S. Cl. ..... 206/315.6; 206/315.3

[58] Field of Search ..... 206/315.2–315.6

[56] References Cited

U.S. PATENT DOCUMENTS

| | | | |
|---|---|---|---|
| 1,818,378 | 8/1931 | Byrne | 206/315.5 |
| 1,845,088 | 2/1932 | Hunerhoff . | |
| 2,438,078 | 3/1948 | Sutphen | 280/36 |
| 2,508,264 | 5/1950 | Johnson | 150/1.5 |
| 2,521,573 | 9/1950 | Filler et al. | 150/1.5 |
| 2,534,096 | 12/1950 | Zapoleon | 206/315.6 |
| 2,760,782 | 8/1956 | Hartzell | 280/36 |
| 2,879,819 | 3/1959 | Turnbull | 206/315.4 |
| 3,316,951 | 5/1967 | Jacobson | 150/52 |
| 3,460,597 | 8/1969 | Daly | 150/1.5 |
| 3,530,919 | 9/1970 | May | 206/315.4 |
| 3,967,667 | 7/1976 | Robinson | 206/315.6 |
| 4,055,207 | 10/1977 | Goodwin | 206/315.6 |
| 4,208,227 | 6/1980 | Cowan | 206/315.6 |
| 4,245,684 | 1/1981 | Street et al. | 206/315.6 X |
| 4,319,616 | 3/1982 | Light | 150/1.5 |
| 4,332,283 | 6/1982 | Rader | 206/315.6 |
| 4,383,563 | 5/1983 | Kirchhoff, Jr. | 206/315.2 |
| 4,522,299 | 6/1985 | Clark et al. | 206/315.3 |
| 4,796,789 | 1/1989 | Willcocks | 224/202 |
| 4,915,221 | 4/1990 | Spangler | 206/315.6 |
| 5,042,654 | 8/1991 | Jones | 206/315.3 |
| 5,071,147 | 12/1991 | Stansbury | 280/47.19 |
| 5,094,345 | 3/1992 | Yonnetti | 206/315.2 |
| 5,103,974 | 4/1992 | Antonious | 206/315.6 |
| 5,135,107 | 8/1992 | Ingraham | 206/315.6 |
| 5,168,992 | 12/1992 | Bowdy | 206/315.6 |
| 5,458,240 | 10/1995 | Rich et al. | 206/315.6 X |
| 5,624,028 | 4/1997 | Shin et al. | 206/315.6 |

FOREIGN PATENT DOCUMENTS

| | | |
|---|---|---|
| 216273 | 10/1955 | Australia . |
| 226654 | 6/1958 | Australia . |
| 689853 | 4/1953 | United Kingdom . |
| 2134797 | 8/1984 | United Kingdom . |
| WO92/16266 | 10/1992 | WIPO . |
| WO96/01668 | 1/1996 | WIPO . |

*Primary Examiner*—Sue A. Weaver
*Attorney, Agent, or Firm*—Workman, Nydegger & Seeley

[57] ABSTRACT

The present invention is directed to a new and useful apparatus for use in carrying, organizing, and protecting golf clubs. The golf club carrying apparatus of the present invention combines secure retention and segregation of the clubs, with a unique, streamlined design. These features facilitate protection of the shafts and heads of the clubs, identification of the presence or absence of a particular club, and prevention of unwanted shifting of the clubs. The present invention incorporates a substantially elliptically-shaped perimeter which has been found to maximize the functionality and sleekness of the apparatus. The golf club carrying apparatus includes both a golf bag body and a tiered retaining apparatus. The golf bag body forms a receptacle for carrying golf clubs, and the tiered retaining assembly secures and protects the clubs. The tiered retaining assembly includes an upper tier, an intermediate tier, and a lower tier. The upper tier serves to retain and protect the woods, especially the head portion, by slanting outwardly and downwardly. The intermediate tier facilitates easy access to the putter. The lower tier houses the irons in a distinct arrangement, organized according to the angle of each particular iron.

43 Claims, 3 Drawing Sheets

GOLF CLUB CARRYING APPARATUS

BACKGROUND OF THE INVENTION

1. The Field of the Invention

The present invention relates generally to an apparatus for carrying golf clubs. More specifically, this invention relates to a golf club carrying apparatus which organizes, secures, and protects the golf clubs therein.

2. The Relevant Technology

Golf, a recreational sport which has been enjoyed by participants for many years, is played on a landscaped course complete with sand traps and water hazards. The object of the game is for the golfer to sink a small, dimpled ball into a four inch hole in the fewest strokes possible. The golfer utilizes golf clubs to accomplish this task successively into each of nine or eighteen holes on a course. Generally, the distance of a particular hole varies from about one to five hundred yards. Although the game, and particularly the golf club design, have evolved over the years, golf clubs traditionally have included long handles or shafts to which are attached shaped heads, the shape of the head depending on the function of the club.

Golfers utilize different clubs in response to the requirements presented by the golf course and the golfer's position therein. A full set of golf clubs typically consists of three woods, ten irons, and a putter. The woods, which are generally standardized with the numbers 1 through 5 and 7, are used by the golfer for long drives, whereas the irons, which are generally standardized with the numbers 3 through 9, are used for shorter shots. The numbers indicate the angle of the face of the club and the corresponding relative degree of loft for the shot. For example, at the beginning of a particular hole, a golfer generally chooses a wood with a low degree of loft for maximum distance. As the golfer approaches the green on the fairway, the golfer generally utilizes irons of ever-increasing number and loft until the ball reaches the green. The putter is employed only on the green where the ball remains on the grass for very short shots requiring increased accuracy. In addition, the golfer may utilize specialized clubs like the pitching wedge and the sand wedge when faced with overcoming the various hazards of the course.

The need for each player to access a variety of clubs necessitated the development of several devices for carrying golf clubs. A traditional device for carrying golf clubs is the golf bag. The traditional golf bag is fabricated of leather or of a fabric or synthetic material and is adapted to allow the player to carry a full compliment of golf clubs. Traditionally these bags are cylindrical in shape with large openings at the top for insertion and removal of the clubs. The clubs are inserted head up, such that the number and function of the club may be ascertained. When the bag is hefted, the clubs can shift putting the bearer off-balance and possibly marring the highly finished surfaces of the clubs.

Alternatively, the golf bag may incorporate simple dividers. Although this offers some segregation, the clubs still shift upon hefting of the bag. Further, the dividers offer minimal protection, if any, to the surfaces of the clubs.

To protect the clubs from abrasions caused by contact with the other clubs, socks are often placed over the heads of the clubs, particularly the costly woods. These socks are inconvenient, however, as they must be removed and stored during play. Further, they do not prevent the clubs from moving or shifting from side to side.

Furthermore, when the clubs shift and bunch together, even in bags with simple dividers, it may be difficult for the golfer to locate the proper club. For example, the putter, which is typically the most used club, is also generally a short club, commonly resulting in the taller clubs concealing it. Such a situation contributes to what, at times, can be a frustrating experience for the golfer.

Along these lines, when the clubs are all grouped together it may be difficult for the golfer to notice the absence of a particular club. Since it is improper under golf etiquette or golf course rules to take one's bag actually onto the green, it is common for a golfer to remove both a putter and a highly angled pitching wedge from the golf bag just prior to reaching the green. It sometimes happens that a golfer will inadvertently forget to retrieve the pitching wedge after the hole is complete. In the jumbled disarray of the golf bag, the golfer may not notice that he or she has left the club behind until it is needed at the next hole, as far as five hundred yards away.

In addition, when the clubs shift and bang against each other, they cause a rattling sound which can be slightly annoying or completely disturbing, depending on the mood and score of the player. To prevent this shifting of clubs, some bags incorporate club holders which hold the grip or shaft of the club. These club holders, however, may cause premature wear on the clubs.

Similarly, the traditional bag is of a height which contacts the average golf club on the shaft well below the head of the club. Not only does this allow the heads to knock against each other, but it also allows the heads of the shorter clubs to knock against the shafts of the taller clubs. The shafts also collide with the upper edge of the bag, which may cause a substantial force against the shaft, especially when the bag is hefted. Over time this could substantially diminish the performance of the clubs due to weakening or even slight bending of the shafts. Furthermore, when the edges of traditional bags contact shafts made of graphite, there is significant damage to the painted finish that results in a bare ring around the shaft.

SUMMARY AND OBJECTS OF THE INVENTION

It is, therefore, an object of the present invention to provide an improved golf club carrying apparatus which protects the head of each golf club from being abraded or marred by contact with the other golf clubs retained therein.

Another object of the present invention is to provide an improved golf club carrying apparatus which protects the shaft of each golf club from being damaged by contact with the other golf clubs retained therein or with the upper rim of the apparatus.

It is another object of the present invention to provide an improved golf club carrying apparatus which facilitates a golfer's identification and removal of an appropriate club.

Still another object of the present invention is to provide an improved golf club carrying apparatus which decreases the probability of loss of a club due to a golfer's inadvertent failure to detect the absence thereof.

Another object of the present invention is to provide an improved golf club carrying apparatus which distinctly compartmentalizes the clubs.

Yet, another object of the present invention is to provide an improved golf club carrying apparatus wherein the irons face outward along an upper rim of the apparatus.

It is still another object of the present invention to provide an improved golf club carrying apparatus which facilitates a golfer's access to the putter.

A further object of the present invention is to provide an improved golf club carrying apparatus which virtually lacks rattling or other distracting noises caused by the clubs knocking into one another or by shifting within the apparatus.

It is a further object of the present invention to provide a golf club carrying apparatus in which the clubs are positioned such that they do not shift upon shouldering of the apparatus thereby putting the bearer off-balance, or shift upon placement of the bag on the ground thereby causing the bag to fall over.

Another object of the present invention is to provide an improved golf club carrying apparatus wherein the club compartments and apparatus rims are made of firm, yet flexible materials.

It is another object of the present invention to provide a golf club carrying apparatus which retains the golf clubs without promoting wear on the grip area of the clubs.

It is yet another object of the present invention to provide a golf club carrying apparatus which is stream-lined to reduce the size and bulk of the apparatus.

To achieve the foregoing objects, and in accordance with the invention as embodied and broadly described herein, the present invention is directed to a new and useful apparatus for use in carrying and protecting golf clubs.

In the presently preferred embodiment of the present invention, the golf club carrying apparatus comprises both a golf bag body and a tiered retaining assembly. The golf bag body forms a receptacle for carrying golf clubs, and the tiered retaining assembly secures and protects the clubs.

In addition, the tiered retaining assembly preferably comprises an upper tier, an intermediate tier, and a lower tier. The upper tier serves to retain and protect the woods, especially the head portion, by slanting outwardly and downwardly. The intermediate tier preferably accommodates the putter for easy access by the golfer thereto. The lower tier preferably houses the irons in a distinct arrangement, organized according to the angle of a particular iron.

The present invention also preferably comprises a substantially elliptically-shaped perimeter which has been found to maximize the functionality and sleekness of the apparatus.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Golf, a popular recreational sport, entails the use of different clubs in response to various requirements presented by a golf course and a golfer's position therein. A golfer typically utilizes a set of golf clubs consisting of woods, irons, and a putter. The clubs, except for certain specialized clubs, are generally represented by numbers which indicate the angle of the face of the club and the corresponding relative degree of loft for the shot.

Therefore, the need for each player to access a variety of clubs necessitated devices for carrying golf clubs. A traditional device for carrying golf clubs is the golf bag, which allows the player to carry a full compliment of clubs. Traditionally golf bags are cylindrical in shape with large openings at the top for insertion and removal of the clubs.

However, when the bag is hefted, the position of the clubs can shift, putting the bearer off-balance and possibly marring the finished surfaces of the clubs. Furthermore, when the clubs shift and bunch together, even in the bags with dividers, it may be difficult for the golfer to locate or notice the presence or absence of a particular club. In addition, when the clubs shift and bang against each other, they cause an annoying rattling sound that some have attempted to prevent by incorporating club holders which hold the grip or shaft of the club. These holders, however, may cause premature wear on the clubs.

Furthermore, the traditional bag is of a height which contacts the average golf club on the shaft well below the head of the club. As a result, the heads knock against each other, and the heads of the shorter clubs knock against the shafts of the taller clubs. The shafts also collide with the upper edge of the bag, which may cause a substantial force against the shaft, especially when the bag is hefted. Over time the performance of the clubs may be diminished due to weakening or even slight bending of the shafts, and the appearance of the clubs may be diminished due to the paint wearing off the graphite shafts.

WO96/01668, published on Jan. 25, 1996, now abandoned, herein incorporated by reference in its entirety, discloses a golf club case in which all the clubs, except for the putter, are placed in wells around the perimeter of the case. The putter is placed in an angled well removed from the perimeter of the case. In all other respects, this golf club case does not segregate the remaining clubs in any particular manner.

In contrast, the golf club carrying apparatus of the present invention combines secure retention and segregation of the clubs with a unique, streamlined design. These features facilitate protection of the shafts and heads of the clubs, identification of the presence or absence of a particular club, and prevention of unwanted shifting of the clubs.

Figure 1:
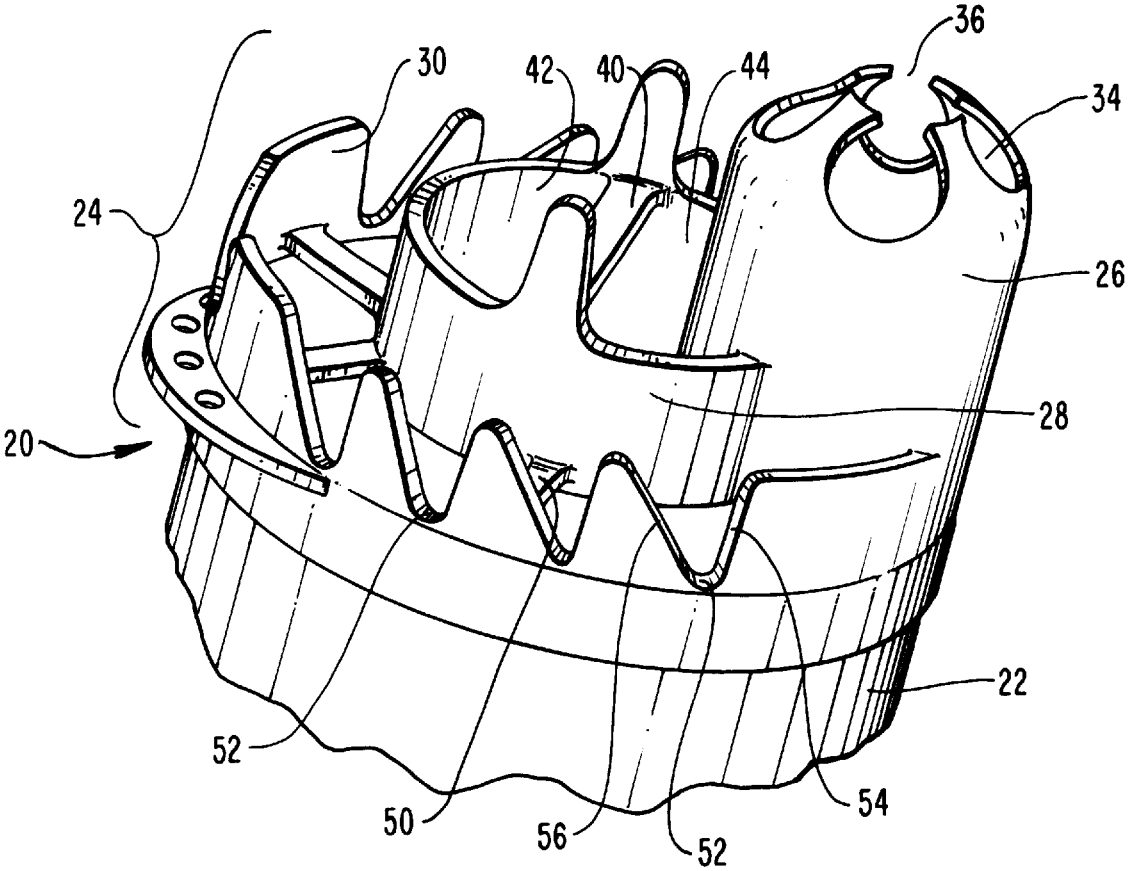
FIG. 1 is a three-dimensional partial perspective view of the golf club carrying apparatus of the present invention.

FIG. 1 is a visual representation of the features of the present invention that solve the problems encountered with conventional golf club carrying devices. FIG. 1 depicts one presently preferred embodiment of a golf club carrying apparatus, generally labelled 20, comprising both a golf bag body 22 and a tiered retaining assembly 24.

The golf bag body 22 of the apparatus forms a receptacle for carrying golf clubs and other golfing paraphernalia such as, but not limited to, shoes, balls, and towels. The golf bag body 22 terminates superiorly in a tiered retaining assembly 24. The tiered retaining assembly 24 of the golf club carrying apparatus advantageously organizes, secures, and protects the clubs. In a preferred embodiment illustrated in FIG. 1, the tiered retaining assembly 24 comprises three tiers; an upper tier 26, an intermediate tier 28, and a lower tier 30.

Upper tier 26 is positioned most superiorly in the tiered retaining assembly 24, as illustrated in FIG. 1. Preferably, upper tier 26 retains the woods segregated from the remaining golf clubs. When upper tier 26 is used properly, its superior position facilitates a golfer's access to the woods, and protects the woods from each other and from the other clubs.

Figure 2:
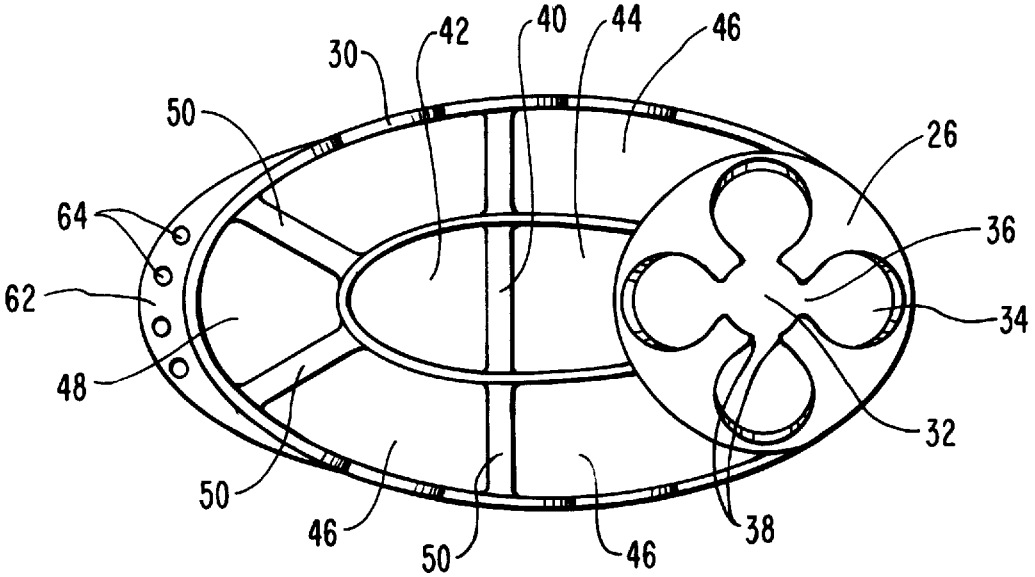
FIG. 2 is a top view of the golf club carrying apparatus of FIG. 1.

Upper tier 26 preferably comprises an insertion aperture 32, best illustrated in FIG. 2. The insertion aperture 32 allows the grip end of a club, preferably a wood, to be inserted into the upper tier of the golf club carrying apparatus. The insertion aperture 32 is sized to accommodate the diameter of the grip end of a wood, but is substantially smaller than the head end of a wood, such that the entire wood will not fall through the insertion aperture into the interior of the golf club carrying apparatus.

It is a feature of the present invention that a wood drops into a retaining cavity 34 for holding and protecting the wood. In a presently preferred embodiment best illustrated in FIG. 2, upper tier 26 comprises four retaining cavities. Each retaining cavity 34 slopes outwardly and downwardly from insertion aperture 32, as illustrated in FIG. 1. This outward and downward slope combined with the weight of the head of the wood and the force of gravity, facilitate movement of the wood into a retaining cavity. These same forces additionally serve to maintain the position of the wood in a retaining cavity. In addition, the downward and outward slope of each retaining cavity prevents the wood, once contained therein, from accidental dislodgement. Yet, a golfer can easily and selectively remove the wood as needed.

Each retaining cavity 34 is additionally sized such that it accommodates the shaft of a wood without allowing the head end to fall through the retaining cavity and into interior of the golf club carrying apparatus. Rather, each retaining cavity 34 supports the head of a wood and substantially encircles only the upper-most portion of the shaft of a wood.

Each retaining cavity 34 opens upwardly and inwardly into insertion aperture 32. The opening 36 of each retaining cavity 34 is surrounded on either side by a retaining lip 38 which further ensures the retention of a wood in a retaining cavity 34. Each retaining lip 38 and retaining cavity 34 preferably comprise a firm, yet flexible material such that the shaft of a wood is not damaged upon insertion or retrieval thereof from the upper tier 26.

Figure 6:
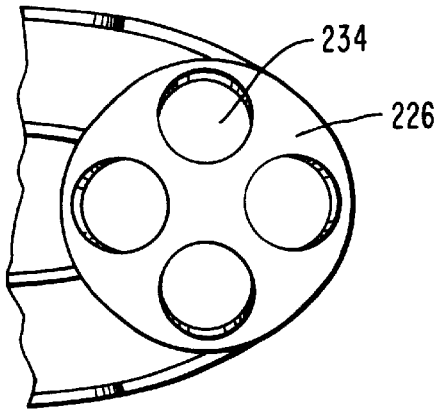
FIG. 6 is a top view of yet another embodiment of a portion of the golf club carrying apparatus for retaining woods.

In an alternative embodiment illustrated in FIG. 6, upper tier 226 omits an insertion aperture. Instead, the woods are inserted directly into the apparatus through a retaining cavity 234.

Figure 4:
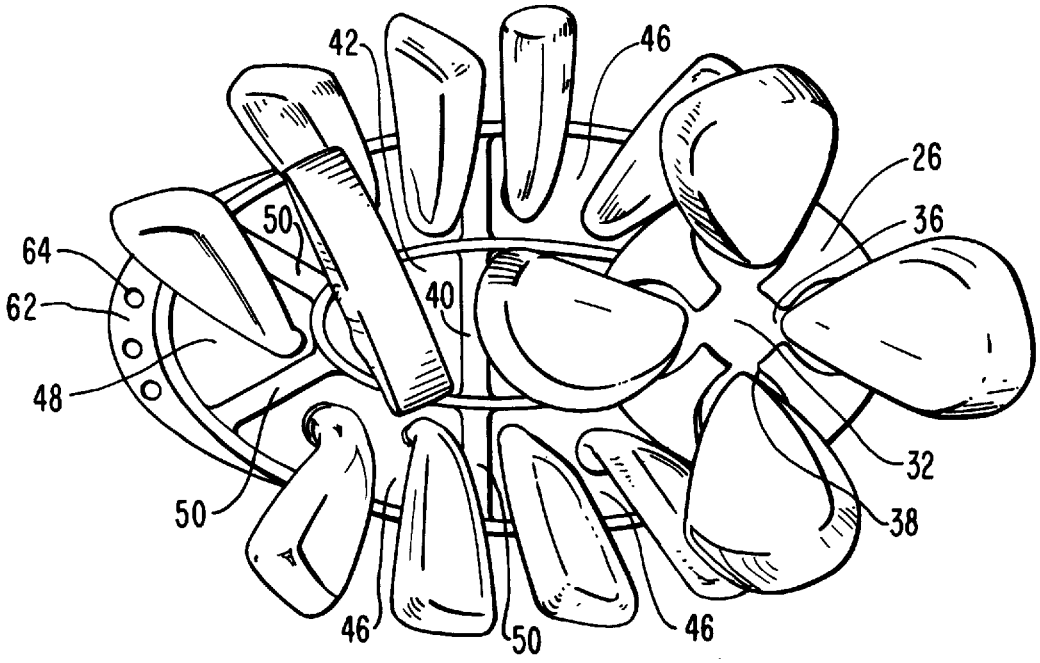
FIG. 4 is a top view of the golf club carrying apparatus of FIG. 1 with golf clubs retained therein.

The positioning of each retaining cavity 34 additionally ensures separation of the woods such that the head of one wood does not contact the head of another. FIG. 2 illustrates a preferred embodiment of such positioning wherein each of four retaining cavities resides in upper tier 26 at approximately ninety degree angles from each neighboring retaining cavity. The resulting four-lobed formation maximizes the separation of the heads of as many as four woods retained in the upper tier, as illustrated in FIG. 4.

Figure 5:
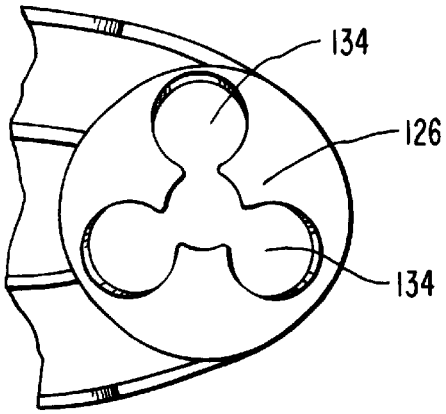
FIG. 5 is a top view of another embodiment of a portion of the golf club carrying apparatus for retaining woods.

However, the four-lobed retaining cavity is but one embodiment of the retaining means for holding and protecting the woods of the present invention. It should be appreciated that alternate numbers and arrangements of retaining means in the upper tier would fall within the scope of the present invention. For example, FIG. 5 illustrates an alternate embodiment of the present invention wherein the upper tier 126 comprises three retaining cavities 134. The resulting formation resembles a three-leafed clover, which maximizes the separation between the heads of as many as three woods.

It should also be understood, that one, two, or even, but not limited to, five retaining cavities could also be positioned in the upper tier to separate the heads of one, two, or five woods, respectively. FIG. 6 additionally illustrates another embodiment wherein four retaining cavities 234 reside in upper tier 226 absent a separate insertion aperture.

Furthermore, the retaining means is not limited to equally spaced or identically sized cavities. Rather, the present invention additionally envisions angular, oval, square, and asymmetrical retaining means for holding and protecting the woods.

Lower tier 30 forms the lower-most level of tiered retaining assembly 24. Preferably, lower tier 30 retains the irons segregated from the remaining golf clubs. When lower tier 30 is used properly, its position facilitates a golfer's access to the irons, organizes the irons, and protects the irons from the other clubs.

In a preferred embodiment illustrated in FIG. 1, lower tier 30 comprises five apertures which provide access in lower tier 30 through which the irons in a set of clubs enter the golf club carrying apparatus 20. Preferably, four transverse dividers 50 separate the five apertures into four double apertures 46 each of which accommodates two irons, and one single aperture 48 which accommodates one iron. In a preferred embodiment, the five apertures effectuate initial segregation of the clubs upon insertion of an iron through one of the apertures, and the transverse dividers offer added strength and support to the apparatus.

Still, the aforementioned arrangement of the four transverse dividers and the five apertures is directed to a standard set of clubs consisting of nine irons. It should be appreciated that the present invention is in no way limited to such an arrangement. However, the lower tier necessitates at least one aperture through which a club may be introduced into the apparatus.

Moreover, after insertion of an iron into lower tier 30 through one of the apertures, the iron is preferably further segregated by one or more angular slots 52. In a preferred embodiment illustrated in FIG. 1, nine angular slots 52 substantially encircle the outer perimeter of lower tier 30. Preferably, the nine angular slots segregate nine irons such that each individual iron is retained in each angular slot according to the number of the iron and corresponding angle of the angular slot.

Figure 3:
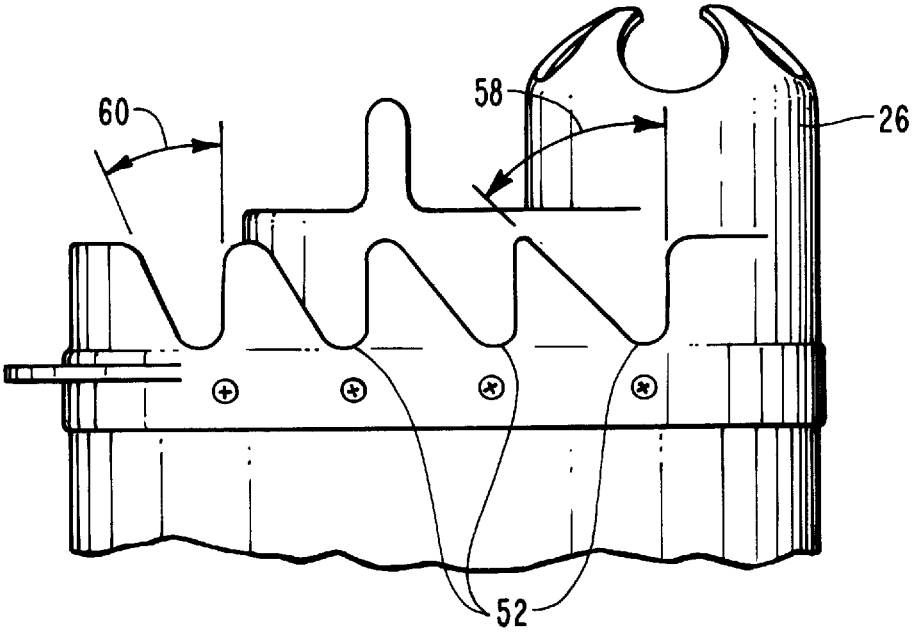
FIG. 3 is a partial side view of the golf club carrying apparatus of FIG. 1.

In a preferred embodiment, the angle of each angular slot 52 increases progressively around the lower tier 30 in accordance with the relative change in the angle of the irons. In such and arrangement, the angular slot with the lowest degree preferably secures a moderately angled iron, such as a 2 or a 3 iron. The angles increase progressively securing more highly angled irons and terminating with a highly angled iron, such as a 9 iron or a pitching wedge. A preferred embodiment of such angular variation is illustrated in FIG. 3, wherein angle 58 is larger in degree than angle 60.

Each angular slot 52 preferably comprises a vertical edge 54 and an angular edge 56. In a preferred embodiment, vertical edge 54 remains substantially vertical in each angular slot around the perimeter of lower tier 30. Each angular edge 56, on the other hand, preferably slants according to the relative angle of the face of an iron. In such an embodiment, the angle of each angular slot either decreases or increases progressively around the lower tier, depending of course, on the point of origin.

Essentially, the angular differentiation of the angular slots organizes the irons by the degree of angle of the face of the iron, and thus by corresponding number. Once properly positioned, such arrangement facilitates a golfer's identification and removal of an appropriate iron, and also makes it easy for a golfer to recognize the fact of a missing iron.

In addition, the relative fit of an iron within each angled slot preferably approximates the size and pitch of an individual iron to prevent side to side movement and shifting of the iron within the apparatus, yet also allows for club angle variations. Alternatively, it should also be understood that the angular slots may incorporate a master or generic angle. In such an arrangement, however, more of the organizational burden would fall on the golfer. Additionally, a certain degree of secure retention associated with more customized angular slots would be lost.

The angular slot is but one example of the segregation means for organizing and protecting the clubs of the present invention. It should be understood, however, that arcuate, triangular or various other shaped segregation means would also be within scope of the present invention. Furthermore, in response to the needs of the golfer or the number of clubs, the present invention is not limited to nine, but may include a greater or a lesser number of segregation means.

It is another feature of the present invention that lower tier 30 protects the irons retained therein. As illustrated in FIG. 4, the irons in lower tier 30 preferably face outward, which maximizes the separation between and organization of the irons. In addition, this outward arrangement further promotes the sleek design and decreased bulk of the apparatus as a whole. Lower tier 30 also contacts each iron just below the head, and thus prevents wear on the shafts of the irons.

Lower tier also preferably includes a golf tee holder 62. FIG. 2 illustrates the preferred placement of golf tee holder 62 with four tee receiving holes 64. In a preferred embodiment, the golf tee holder 62 comprises a crescent-shaped, horizontal protrusion from lower tier 30.

It is also a feature of the present invention that one may include an intermediate tier 28 positioned inferiorly to upper tier 26, superiorly to lower tier 30, and substantially in the middle of the tiered retaining assembly 24. Preferably, intermediate tier 28 retains the putter segregated from the remaining golf clubs. When intermediate tier 28 is used properly, its position facilitates a golfer's access to the putter, the only club consistently used by golfers essentially every hole. Further, such segregation protects the putter from the other clubs. Moreover, the location of the intermediate tier allows it to accommodate virtually any putter, in spite of the great variety of putter shapes and sizes currently available.

Preferably, intermediate tier comprises partition 40 which adds strength to the apparatus and forms two open sections, first access opening 42 and second access opening 44. In a preferred embodiment, first access opening 42 accommodates the putter, while second access opening 44 accommodates a ball retriever, an umbrella, another club, or other suitable golf paraphernalia. It should also be understood that in an alternative embodiment, intermediate tier 28 could omit partition 40, which would result in a single access opening, preferably for retaining the putter.

Figure 7:
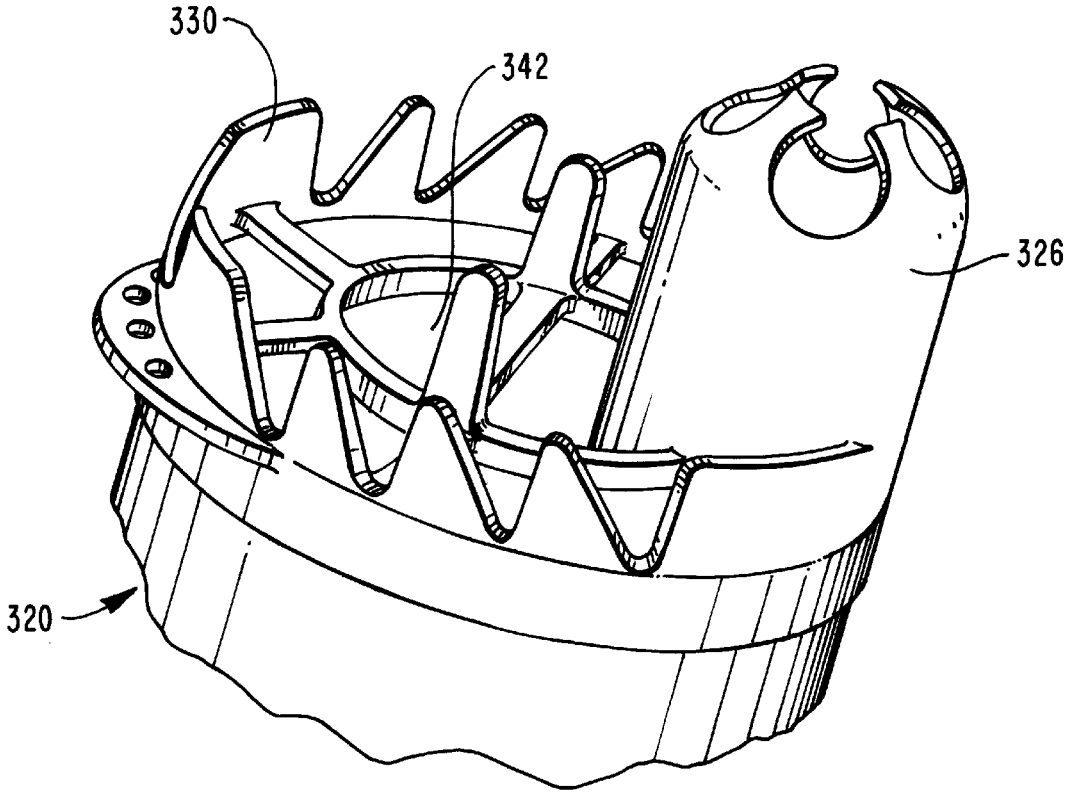
FIG. 7 is a three-dimensional partial perspective view of another embodiment of the golf club carrying apparatus.

Furthermore, as illustrated in FIG. 7, an alternate embodiment of tiered retaining assembly 320 of the golf club carrying apparatus omits the intermediate tier, and instead comprises upper tier 326 and lower tier 330. In such an arrangement, the putter may be retained in the middle aperture 342 of lower tier, or as per the preference of the golfer. It should also be appreciated that more than three tiers would be within the scope of the present invention.

It is a feature of the present invention that the golf club carrying apparatus of the present invention preferably comprises a substantially elliptically-shaped perimeter which has been found to maximize the functionality and sleekness of the golf club carrying apparatus while minimizing the bulk and weight thereof. FIG. 2 illustrates the substantially elliptical shape of a preferred golf club carrying apparatus. It should be understood, however, that the present invention is not limited to an elliptical shape; more rectangular or more rounded shapes could also be utilized with the apparatus of the present invention.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

It is claimed:

1. An apparatus for carrying, protecting, and organizing golf clubs comprising:

a) a golf bag body for receiving golf clubs; and b) a tiered assembly secured at the superior portion of said golf bag body for retaining said golf clubs, said tiered assembly further comprising:

i) an upper tier adapted for retaining at least one wood, said upper tier comprising an elevated cylindrical element, said elevated cylindrical element terminating superiorly in a convex head portion, said convex head portion including an insertion aperture for receiving a shaft end of said at least one wood, said insertion aperture opening into a plurality of retaining cavities for holding and protecting a head end of said at least one wood; and ii) a lower tier adapted for retaining at least one iron.

2. An apparatus as recited in claim 1, wherein said golf bag body and said tiered assembly comprise a substantially elliptically-shaped perimeter.

3. An apparatus as recited in claim 1, wherein said insertion aperture is substantially rounded and of a diameter not significantly larger than the diameter of a conventional shaft of said at least one wood.

4. An apparatus as recited in claim 1, wherein upon insertion into said insertion aperture, said at least one wood drops into one of said plurality of retaining cavities.

5. An apparatus as recited in claim 1, wherein each of said plurality of retaining cavities slopes outwardly and downwardly from said insertion aperture.

6. An apparatus as recited in claim 1, wherein each of said plurality of retaining cavities supports said head end of said at least one wood.

7. An apparatus as recited in claim 1, wherein each of said plurality of retaining cavities averts accidental dislodgement of said at least one wood.

8. An apparatus as recited in claim 1, wherein each of said plurality of retaining cavities prevents said head end of said at least one wood from contacting a head end of another golf club therein.

9. An apparatus as recited in claim 1, wherein each of said plurality of retaining cavities opens upwardly and inwardly into said insertion aperture, wherein each of said plurality of retaining cavities is surrounded on either side by a retaining lip.

10. An apparatus as recited in claim 9, wherein said retaining lip and each of said plurality of retaining cavities comprise substantially firm, yet flexible material.

11. An apparatus as recited in claim 1, wherein said lower tier comprises:

a. at least one aperture for receiving a shaft end of said at least one iron; and b. at least one segregation means for retaining, protecting, and organizing at least one iron.

12. An apparatus as recited in claim 11, wherein said at least one segregation means comprises at least one angular slot.

13. An apparatus as recited in claim 12, wherein said at least one angular slot circumscribes the perimeter of said lower tier.

14. An apparatus as recited in claim 12, wherein said at least one angular slot comprises a vertical edge and an angular edge.

15. An apparatus as recited in claim 14, wherein said angular edge varies the angle of said angular slot according to the relative angle of the head of a club to be inserted therein.

16. An apparatus for carrying, protecting, and organizing golf clubs comprising:

a) a golf bag body for receiving golf clubs;

b) a tiered assembly secured at the superior portion of said golf bag for retaining said golf clubs, said tiered assembly comprising an upper tier and a lower tier;

c) said upper tier comprising an elevated cylindrical element, said elevated cylindrical element terminating superiorly in a convex head portion, said head portion including an insertion aperture for receiving a shaft end of at least one wood, said insertion aperture opening into a plurality of retaining cavities for holding and protecting a head end of at least one wood, said plurality of retaining cavities sloping outwardly and downwardly from said insertion aperture such that said at least one wood drops into one of said plurality of retaining cavities; and d) said lower tier comprising an aperture for receiving a shaft of at least one iron, and at least one segregation means for protecting, organizing and retaining said at least one iron.

17. An apparatus according to claim 16, wherein said golf bag body and said tiered assembly comprise a substantially elliptically-shaped perimeter.

18. An apparatus according to claim 16, wherein said insertion aperture is substantially rounded and of a diameter not significantly larger than the diameter of a conventional shaft of said at least one wood.

19. An apparatus according to claim 16, wherein each of said plurality of retaining cavities averts accidental dislodgement of said at least one wood.

20. An apparatus according to claim 16, wherein said segregation means further comprises at least one angular slot circumscribing the perimeter of said lower tier, said angular slot varying in angle according to the relative angle of the head of a club to be inserted therein.

21. An apparatus for carrying, protecting, and organizing golf clubs comprising:

a) a golf bag body for receiving golf clubs;

b) a tiered assembly secured at the superior portion of said golf bag for retaining said golf clubs, said tiered assembly comprising an upper tier and a lower tier;

c) said upper tier comprising:

i) an elevated cylindrical element terminating superiorly in a convex head portion;

ii) an insertion aperture for receiving a shaft end of at least one wood, said insertion aperture being substantially rounded and of a diameter not significantly larger than the diameter of a conventional shaft of said at least one wood, and said insertion aperture being positioned within said convex head portion of said elevated cylindrical element; and ii) a plurality of retaining cavities for holding and protecting a head end of said at least one wood, each of said retaining cavities sloping outwardly and downwardly from said insertion aperture such that said at least one wood drops into one of said retaining cavities, each of said retaining cavities further averting said at least one wood from accidental dislodgement;

d) said lower tier comprising an aperture for receiving a shaft of at least one iron, and at least one segregation means for protecting, organizing and retaining said at least one iron, said at least one segregation means further comprising:

i) at least one angular slot circumscribing the perimeter of said lower tier, said angular slot varying in angle according to the relative angle of the head of a club to be inserted therein; and e) said golf bag and said tiered assembly comprising a substantially elliptically-shaped perimeter.

22. An apparatus for carrying, protecting, and organizing golf clubs comprising:

a) a golf bag body for receiving golf clubs; and b) a tiered assembly secured at the superior portion of said golf bag body for retaining said golf clubs, said tiered assembly further comprising:

i) an upper tier adapted for retaining at least one wood, said upper tier further comprising an elevated cylindrical element, said elevated cylindrical element terminating superiorly in a convex head portion, said head portion including an insertion aperture for receiving a shaft end of said at least one wood, said insertion aperture opening into a plurality of retaining cavities for holding and protecting a head end of said at least one wood;

ii) an intermediate tier adapted for retaining at least one putter; and iii) a lower tier adapted for retaining at least one iron.

23. An apparatus as recited in claim 22, wherein said golf bag body and said tiered assembly comprise a substantially elliptically-shaped perimeter.

24. An apparatus as recited in claim 22, wherein said insertion aperture is substantially rounded and of a diameter not significantly larger than the diameter of a conventional shaft of said at least one wood.

25. An apparatus as recited in claim 22, wherein upon insertion into said insertion aperture, said at least one wood drops into one of said plurality of retaining cavities.

26. An apparatus as recited in claim 22, wherein each of said plurality of retaining cavities slopes outwardly and downwardly from said insertion aperture.

27. An apparatus as recited in claim 22, wherein each of said plurality of retaining cavities supports said head end of said at least one wood.

28. An apparatus as recited in claim 22, wherein each of said plurality of retaining cavities averts accidental dislodgement of said at least one wood.

29. An apparatus as recited in claim 22, wherein each of said plurality of retaining cavities prevents said head end of said at least one wood from contacting a head end of another golf club therein.

30. An apparatus as recited in claim 22, wherein each of said plurality of retaining cavities opens upwardly and inwardly into said insertion aperture, wherein it is surrounded on either side by a retaining lip.

31. An apparatus as recited in claim 30, wherein said retaining lip and each of said plurality of retaining cavities comprise substantially firm, yet flexible material.

32. An apparatus as recited in claim 22, wherein said lower tier comprises:

a. at least one aperture for receiving a shaft end of said at least one iron; and b. at least one segregation means for retaining, protecting, and organizing at least one iron.

33. An apparatus as recited in claim 32, wherein said at least one segregation means comprises at least one angular slot.

34. An apparatus as recited in claim 33, wherein said at least one angular slot circumscribes the perimeter of said lower tier.

35. An apparatus as recited in claim 33, wherein said at least one angular slot comprises a vertical edge and an angular edge.

36. An apparatus as recited in claim 35, wherein said angular edge varies the angle of said angular slot according to the relative angle of the head of a club to be inserted therein.

37. An apparatus as recited in claim 22, wherein said intermediate tier comprises at least one access opening for retaining said at least one putter.

38. An apparatus for carrying, protecting, and organizing golf clubs comprising:

a) a golf bag body for receiving golf clubs;

b) a tiered assembly secured at the superior portion of said golf bag for retaining said golf clubs, said tiered assembly comprising an upper tier, an intermediate tier, and a lower tier;

c) said upper tier comprising an elevated cylindrical element, said elevated cylindrical element terminating superiorly in a convex bead portion, said convex head portion including an insertion aperture for receiving a shaft end of at least one wood, said insertion aperture opening into a plurality of retaining cavities for holding and protecting a head end of said at least one wood, each of said plurality of retaining cavities sloping outwardly and downwardly from said insertion aperture such that said at least one wood drops into one of said plurality of retaining cavities;

d) said intermediate tier comprising at least one access opening to accommodate at least one putter; and e) said lower tier comprising an aperture for receiving a shaft of at least one iron, and at least one segregation means for protecting, organizing and retaining said at least one iron.

39. An apparatus according to claim 38, wherein said golf bag body and said tiered assembly comprise a substantially elliptically-shaped perimeter.

40. An apparatus according to claim 38, wherein said insertion aperture is substantially rounded and of a diameter not significantly larger than the diameter of a conventional shaft of said at least one wood.

41. An apparatus according to claim 38, wherein each of said plurality of retaining cavities averts accidental dislodgement of said at least one wood.

42. An apparatus according to claim 38, wherein said segregation means further comprises at least one angular slot circumscribing the perimeter of said lower tier, said angular slot varying in angle according to the relative angle of the head of a club to be inserted therein.

43. An apparatus for carrying, protecting, and organizing golf clubs comprising:

a) a golf bag body for receiving golf clubs;

b) a tiered assembly secured at the superior portion of said golf bag for retaining said golf clubs, said tiered assembly comprising an upper tier, an intermediate tier, and a lower tier;

c) said upper tier comprising:

i) an elevated cylindrical element terminating superiorly in a convex head portion;

ii) an insertion aperture for receiving a shaft end of at least one wood, said insertion aperture being substantially rounded and of a diameter not significantly larger than the diameter of a conventional shaft of said at least one wood, and said insertion aperture being positioned within said convex head portion of said elevated cylindrical element; and iii) a plurality of retaining cavities for holding and protecting a head end of said at least one wood, each of said retaining cavities sloping outwardly and downwardly from said insertion aperture such that said at least one wood drops into one of said retaining cavities, each of said retaining cavities further averting said at least one wood from accidental dislodgement;

d) said intermediate tier comprising at least one access opening to accommodate at least one putter;

e) said lower tier comprising an aperture for receiving a shaft of at least one iron, and at least one segregation means for protecting, organizing and retaining said at least one iron, said at least one segregation means further comprising:

i) at least one angular slot circumscribing the perimeter of said lower tier, said angular slot varying in angle according to the relative angle of the head of a club to be inserted therein; and f) said golf bag body and said tiered assembly comprising a substantially elliptically-shaped perimeter.

* * * * *